United States Patent [19]

Ishida et al.

[11] 4,437,378

[45] Mar. 20, 1984

[54] ELECTRONIC MUSICAL INSTRUMENT

[75] Inventors: Hideaki Ishida, Tokyo; Tomohisa Ishikawa, Kawagoe; Koji Yamana; Takehiko Kayahara, both of Tokyo, all of Japan

[73] Assignee: Casio Computer Co., Ltd., Tokyo, Japan

[21] Appl. No.: 361,474

[22] Filed: Mar. 23, 1982

[30] Foreign Application Priority Data

Mar. 30, 1981 [JP] Japan ..... 56-45631
Mar. 30, 1981 [JP] Japan ..... 56-45632
Mar. 30, 1981 [JP] Japan ..... 56-45633

[51] Int. Cl.[3] ..... G10H 3/06

[52] U.S. Cl. ..... 84/1.18; 84/1.28; 84/478

[58] Field of Search ..... 84/1.01, 1.03, 1.18, 84/1.28, 478, DIG. 12, DIG. 29

[56] References Cited

U.S. PATENT DOCUMENTS 3,878,750 4/1975 Kapps ..... 84/1.01
3,913,443 10/1975 Jewett ..... 84/1.28
4,022,097 5/1977 Strangio ..... 84/1.03
4,145,945 3/1979 Iyeta ..... 84/1.18
4,228,716 10/1980 Linford ..... 84/1.18
4,261,241 4/1981 Gould et al. ..... 84/1.18
4,378,720 4/1983 Nakada et al. ..... 84/1.03

FOREIGN PATENT DOCUMENTS 3123845 1/1982 Fed. Rep. of Germany .
1109510 11/1965 United Kingdom .
1534419 12/1978 United Kingdom .
2035664 6/1980 United Kingdom .
2044511 10/1980 United Kingdom .
2045504 10/1980 United Kingdom .
2055504 3/1981 United Kingdom .
2062341 5/1981 United Kingdom .
2078428 1/1982 United Kingdom .

*Primary Examiner*—S. J. Witkowski
*Attorney, Agent, or Firm*—Frishauf, Holtz, Goodman and Woodward

[57] ABSTRACT

Bar code data are read out by a bar code reader from a medium on which predetermined tone data are printed in the form of bar codes and are successively stored in a RAM. When a mode selection switch is set to a position "NAVI", a LED provided in the vicinity of a performance key corresponding to the pitch of a tone next to be produced next, is turned on under the control of a control section. Performance of music can be obtained by successively operating performance keys indicated by associated LEDs turned on one after another.

5 Claims, 18 Drawing Figures

NOR
NAVI
REC
B.C.R
IKey
AUTO
REC
AUTO
IKey
M
KEY MATRIX
DECODER
KI
KT
CONTROL SECTION
R/W
RD
R
P
A
B
R1
R2
RAM
LATCH
DRIVER
DRIVER
DISPLAY SECTION
DECODER
LED MATRIX
DECODER
COUNTER
COINCIDENCE CIRCUIT
LATCH
TONE GENERATING SECTION
BAR CODE READER
AUTO-PLAY CONTROL SECTION
ADDR. COUNT.
TONE LENGTH COUNTER
DT
36a
36b
36

| OPERATION DATA | CODE |
|---|---|
| DUMMY | 0 0 0 0 |
| START MARK | 0 0 1 0 |
| PITCH DATA DESIGNATION | 0 0 0 1 |
| TONE DURATION DATA DESIGNATION | 0 0 1 0 |
| PITCH DATA START MARK | 1 0 1 1 0 0 0 0 |
| TONE DURATION DATA START MARK | 0 0 0 0 0 0 0 0 |
| END MARK | 1 1 1 1 |
| CONTINUATION | 0 |
| TERMINATION | 1 |

FIG. 7

| NOTE DATA | CODE |
|---|---|
| C | 1000 |
| C# | 0100 |
| D | 1100 |
| D# | 0010 |
| E | 1010 |
| F | 0110 |
| F# | 1110 |
| G | 0001 |
| G# | 1001 |
| A | 0101 |
| A# | 1101 |
| B | 0011 |

FIG. 8

| OCTAVE DATA | CODE |
|---|---|
| C1~B1 | 1000 |
| C2~B2 | 0100 |
| C3~B3 | 1100 |
| C4~B4 | 0010 |
| C5~B5 | 1010 |
| C6~B6 | 0110 |

FIG. 9

| NOTE DATA | CODE |
|---|---|
| REST | 00000000 |

FIG. 10

| NOTE DATA | CODE |
|---|---|
| F4 | 01100010 |

FIG. 11

| NOTE DATA | | CODE |
|---|---|---|
| 𝅝 | WHOLE NOTE | 00001100 |
| 𝅗𝅥. | DOTTED HALF NOTE | 00100100 |
| 𝅗𝅥 | HALF NOTE | 00011000 |
| ♩. | DOTTED QUARTER NOTE | 01001000 |
| ♩ | QUARTER NOTE | 00110000 |
| ♪. | DOTTED 8TH NOTE | 10010000 |
| 3 | TRIPLET OF QUARTER NOTE | 00010000 |
| ♪ | 8TH NOTE | 01100000 |
| 3 | TRIPLET OF 8TH NOTE | 00100000 |
| 𝅘𝅥𝅯 | 16TH NOTE | 11000000 |
| 3 | TRIPLET OF 16TH NOTE | 01000000 |

FIG. 12

0000 0010 0001 10110000 00110010 00010010 00110010 00010010 00110010 00010010 01010010
(1) (2) (3) (4) (5) (6) (7) (8) (9) (10) (11)

01010010 00110010 10001010 01010010 00110010 00010010 1111 0 1000
(12) (13) (14) (15) (16) (17) (18) (19) (20)

0000 0010 0001 01010010 00110010 00010010 00110010 00010010 00110010 00010010 01010010
(21) (22) (23) (24) (25) (26) (27) (28) (29) (30) (31)

01010010 00110010 10001010 01010010 00110010 00010010 1111 0 0100
(32) (33) (34) (35) (36) (37) (38) (39) (40)

0000 0010 0001 00000000 11001010 00110010 11001010 10101010 11001010 00110010 11001010
(41) (42) (43) (44) (45) (46) (47) (48) (49) (50) (51)

1000 1010 10001010 01010010 10001010 00110010 1111 0 1011
(52) (53) (54) (55) (56) (57) (58) (59)

0000 0010 0001 00010010 00110010 01010010 00000000 00010010 00010010 01010010 01010010
(60) (61) (62) (63) (64) (65) (66) (67) (68) (69) (70)

00110010 00110010 10001010 00110010 0101 0010 00010010 1111 0 1100
(71) (72) (73) (74) (75) (76) (77) (78) (79)

00000010 0001 01010010 00010010 11100010 00010010 00000000 1111 1 1110
(80) (81) (82) (83) (84) (85) (86) (87) (88) (89) (90)

FIG. 13

0000001000100000000000011000001100000001100001100000001100001100000001001001
(101) (102) (103) (104) (105) (106) (107) (108) (109) (110) (111)

0011000000110000 00110000 00011000 00110000 00100100 00100100 1111 0 0011
(112) (113) (114) (115) (116) (117) (118) (119) (120) (121)

0000001000100001100 00110000 00011000 00110000 00011000 00110000 00100100 00110000
(122) (123) (124) (125) (126) (127) (128) (129) (130) (131) (132)

00110000 00110000 00011000 00110000 00001100 00011000 00110000 1111 0 1010
(133) (134) (135) (136) (137) (138) (139) (140) (141) (142)

0000001000100011000001100000010010001100000011000001100001001000011000
(143) (144) (145) (146) (147) (148) (149) (150) (151) (152) (153)

0011000001100000011000000110000001100000001100001000 1111 0 0110
(154) (155) (156) (157) (158) (159) (160) (161) (162) (163)

0000001000100001100001100000001100001100000001100001100000010010001100000
(164) (165) (166) (167) (168) (169) (170) (171) (172) (173) (174)

0011000000110000001100000011000000110000001100000011000 1111 1 0011
(175) (176) (177) (178) (179) (180) (181) (182) (183) (184)

ELECTRONIC MUSICAL INSTRUMENT

BACKGROUND OF THE INVENTION

This invention relates to electronic musical instruments which are provided with a bar code reader for reading bar code data from a recording medium on which bar codes representing predetermined musical data are printed.

Recently, electronic musical instruments having an auto play function, which is obtained by preliminarily storing musical data including tone data constituting a predetermined piece of music in a predetermined memory, and by which the individual tone data are automatically and successively read out from the memory according to the progress of music to produce automatic performance of that piece of music, have been developed.

For storing tone data in the memory, various methods of coupling the tone data to the memory have been contemplated. For example, it has been the practice with electronic keyboard musical instruments to let tone data corresponding to operated performance keys be directly and successively coupled to the memory, or transfer tone data preliminarily recorded on an external recording medium such as a magnetic tape or a magnetic card to an intermal memory.

The method of coupling tone data to the memory by operating performance keys, however, requires actual performance of melody, which is considerably difficult to beginners as well as giving rise to many errors and requiring, long time for coupling the data. The method of coupling data via a magnetic tape or a magnetic card, requires an expensive recording medium. In addition, the storage capacity is usually small, thus imposing, restriction upon the quantity of data to be coupled.

SUMMARY OF THE INVENTION

An object of the invention is to provide an electronic musical instrument, with which it is possible even for a beginner to couple tone data accurately and speedily to a memory by a simple operation, and which permits practice or appreciation of a music performance in various modes using tone data stored in the memory.

According to the invention, the above object is attained by an electronic musical instrument, which comprises a bar code reader for reading out bar code data from a recording medium on which bar codes representing predetermined tone data including at least pitch data are printed, memory means for digitally storing bar code data read out by the bar code reader, reading control means for controlling the successive reading of bar code data stored in said memory means in conformity to a given purpose of performance, and tone generating means for generating tones according to bar code data read out under the control of the reading control means.

BRIEF DESCRIPTION OF THE DRAWINGS

FIG. 5 is a view of exemplary bar codes and corresponding logic values;

FIGS. 6 to 11 are views showing relations of various function data and tone data used in the embodiment, to corresponding codes;

FIG. 12 is a view showing codes representing the pitches of corresponding successive tones of a predetermined piece of music;

FIG. 13 is a view showing codes representing the tone durations of the same piece of music;

DETAILED DESCRIPTION OF THE PREFERRED EMBODIMENTS

An embodiment of the invention will be described in detail with reference to the accompanying drawings.

Figure 1:
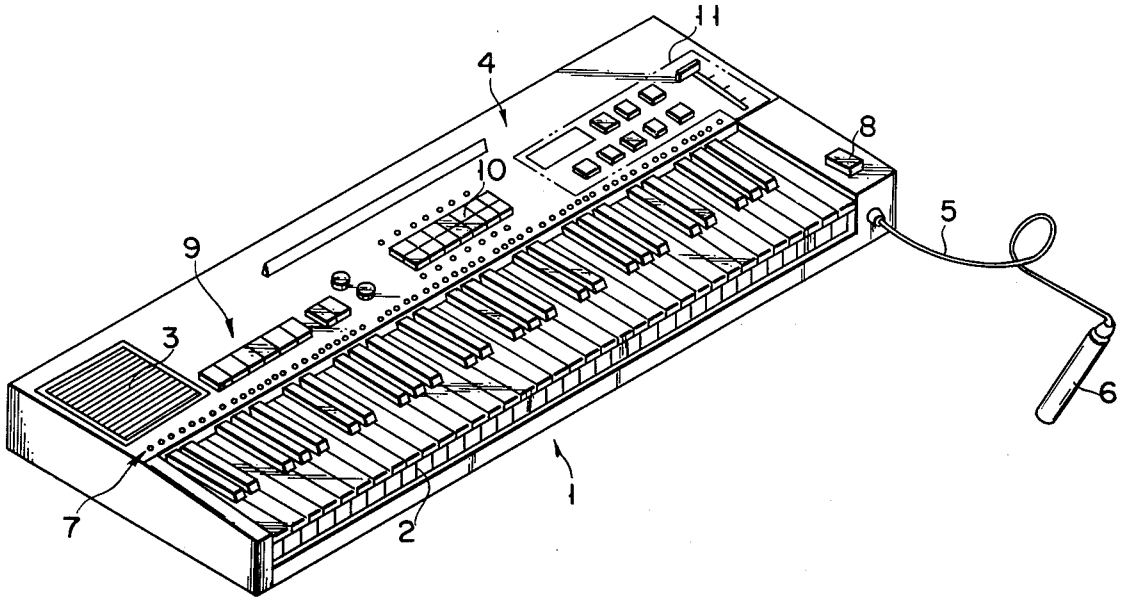
FIG. 1 is a perspective view showing an electronic musical instrument provided with a bar code reader as one embodiment of the invention.
Figure 4:
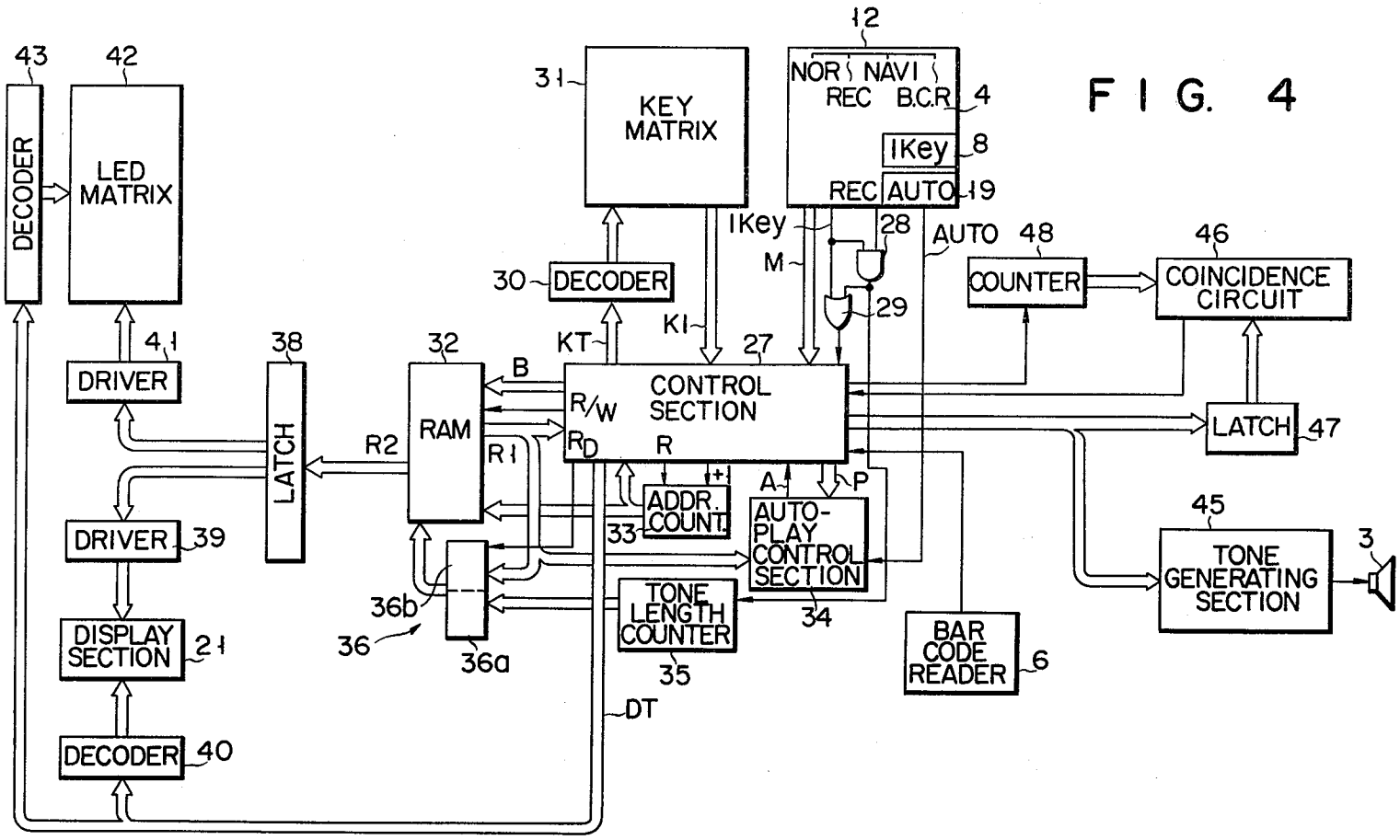
FIG. 4 is a block diagram of the same embodiment.

Referring to FIG. 1, there is shown a body 1 of an electronic keyboard musical instrument, which is provided with a keyboard 2, a loudspeaker 3 and an operating section 4, and to which a bar code reader (hand scanner) 6 is connected via a cord 5. Inside the body 1, LSI parts constituting an electric circuit as shown in FIG. 4 and a tone generating circuit (not shown) are provided. In the vicinity of the keyboard 2, display members 7 are provided to face the individual keys. The display members 7 consist of, for instance, light-emitting diodes (LED). When they are turned on, they instruct that the corresponding keys are to be operated. The operating section 4 includes a one key play key 8 which is used for one key play performance, rhythm specification switches 9, tone color specification switches 10 and a function setting section 11 as shown in detail in FIG. 2. The one key play key 8 is used when coupling tone duration data as well. The period until the one key play key 8 is operated for the second time after an operation thereof for the first time, is coupled as tone duration data.

Figure 2:
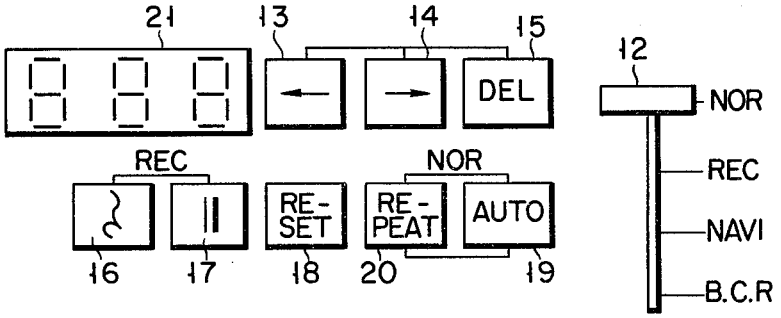
FIG. 2 is a plan view showing an operating section of the electronic musical instrument shown in FIG. 1.

The construction of the function setting section 11 of the operating section 4 as shown in FIG. 2 will now be described. In FIG. 2, a slidable mode selection switch, 12 has a switch position NOR representing a normal performance mode, a switch position REC representing a recording mode, a switch position NAVI representing a navigate mode (in which a key to be operated next is indicated by turning on the LED provided at the corresponding position as a guide for the performance of a predetermined piece of music) and a switch position B.C.R. representing a mode in which the bar code reader 6 is set in an operative state.

Also shown are switches 13 to 20, respectively. The switches 13 to 15 are used when correcting the content once stored in a random access memory (RAM) to be described later. More particularly, the switch 13 is operated for reducing the specified address of the RAM according to the number of times of the switch operation, the switch 14 is operated to increase the address of the RAM according to the number of times of the switch operation, and the switch 15 is operated for deleting the content of an address specified memory area among the memory areas of the RAM. Thus, when erroneous data is set in the RAM, it may be changed to correct data by operating the switches 13 to 15.

The switches 16 and 17 are used when writing tone data of a desired piece of music in the RAM, by setting the recording mode with the mode selection switch 12 set to the position REC. More particularly, the switch 16 is a rest switch for coupling a rest data, and the switch 17 is an end switch for coupling an end data specifying the end of a piece of music and is used after the tone data for the piece of music are all written in the RAM.

The switch 18 is a reset switch for resetting a given circuit to the initial state.

The switches 19 and 20 are used when causing tone data (pitch data and duration data) preliminarily written in the RAM to be automatically and successively read out from the RAM for automatic performance of a predetermined piece of music to be produced by the musical instrument in the normal performance mode which is set by switching the mode selection switch 12 to the switch position NOR. More particularly, the switch 19 is an auto play switch for specifying the start of the automatic performance, and the switch 20 is a repeat switch for specifying a number of times of repeated automatic performance according to the number of times of operation of the switch 20.

A display section 21 is provided for digitally and optically displaying the available storage capacity (prevailing storage capacity) of the RAM during the operation of writing the data in the RAM. The display section 21 consists of a matrix array of row electrodes and column electrodes. In this embodiment, it is a 3-digit display unit.

Figure 3:
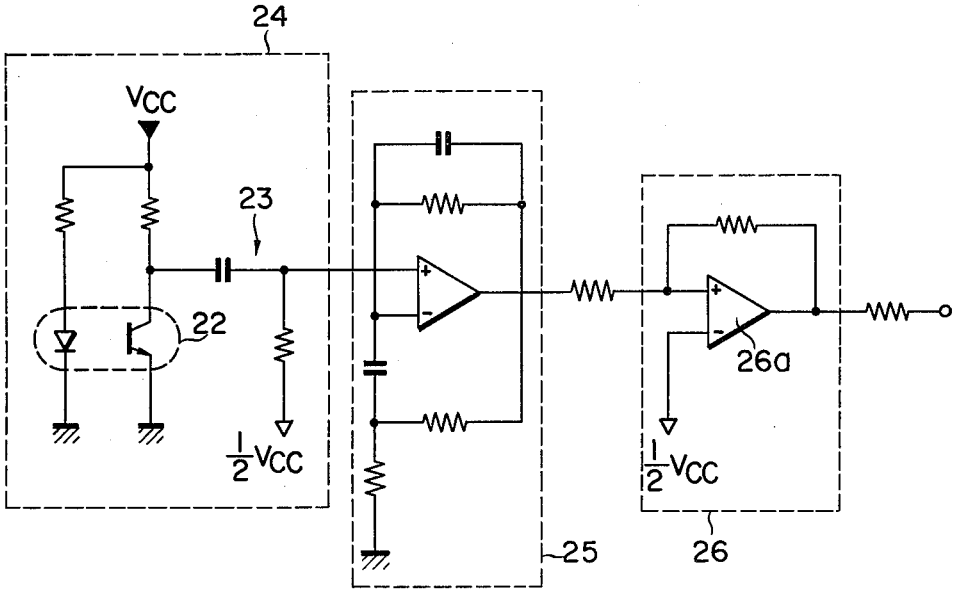
FIG. 3 is a circuit diagram showing a bar code reader.

The circuit construction of the bar code reader 6 is as shown in FIG. 3. A photo-reflector 22, which is provided at the end of the bar code reader 6, is a light-emitting and light-receiving element for converting the difference of light reflectivity into a corresponding electric signal (i.e., magnitude of current). Its output is differentiated in a differentiating circuit 23 to obtain output from a photo-electric converting section 24. This output is amplified by an alternating current amplifying section 25, the output of which is supplied to a voltage comparator section 26. The voltage comparator section 26 includes an operational amplifier **26*a* for comparing the output of the alternating current amplifying section 25 with reference to a comparison level $\frac{1}{2}$ Vcc, and the output of the operational amplifier 26*a*** constitutes a logic signal.

The circuit construction of the electronic keyboard musical instrument will now be described with reference to FIG. 4. The mode specification signals provided from the respective switch positions NOR, REC, NAVI and B.C.R. of the mode selection switch 12 are supplied to a control section 27 via a bus line M. The recording mode specification signal provided from the switch position REC of the mode selection switch 12 enables an AND gate 28. In this state, a signal, 1 key is generated with the operation of the one key play key 8 and is provided from the AND gate 28. The output signal of the AND gate 28 is supplied through an OR gate 29 to a control section 27.

In the control section 27, microprograms for controlling the operation of the musical instrument in the various modes are stored, and the contral section discriminates the mode corresponding to the input mode specification signal and produces various microinstructions corresponding to the discriminated mode while also providing a microinstruction in response to the appearance of the signal 1 key. The control section 27 provides a timing signal KT through a decoder 30 to a key matrix circuit 31. As keys on the keyboard 2 are operated, the key matrix circuit 31 selectively supplies the timing signal KT as key operation signal KI, according to the operated keys, to the control section 27. The control section 27 supplies a scale specification signal based on the input key operation signal to a tone generating section 45, which produces a tone signal supplied to a loudspeaker 3 for producing sound. The control section 27 supplies pitch data corresponding to the input key operation signal KI through a bus line B to a RAM 32.

In the RAM 32, tone data for a series of tones forming a piece of music, and duration data to be described later, are stored. In the RAM 32, the operations of reading and writing the aforementioned pitch data and duration data are controlled according to a read/write control signal R/W provided from the control section 27. The read/write control signal R/W specifies the reading operation of the RAM 32 when the mode selection switch 12 is in the switch position NOR or NAVI, while it specifies the writing operation of the RAM 32 when the mode selection switch 12 is in the switch position REC or B.C.R. In the RAM 32, addresses of the areas for storing the pitch data and duration data are specified by address data providd from an address counter 33. The address data are also supplied to the control section 27.

The content of the address counter 33 is reset by a reset signal R provided from the control section 27, and it is incremented by "+1" every time a "+1" signal is provided from the control section 27. The reset signal R is provided when the reset switch 18 on the operating section 4 is operated and also when the mode selection switch 12 is operated for switching. The "+1" signal is provided when a key on the keyboard 2 is operated under a constant condition wherein the musical instrument of the instant embodiment is set in a particular operation mode. The signal is also provided every time the one key play key 8 is operated. It is further provided whenever a coincidence signal provided from a coincidence circuit 46 is supplied as a tone termination signal to the control section 27 at the termination of the sound producing operation for each tone from the tone generating section 45. Further, it is provided for every predetermined number of bits of bar code data read out when writing bar code data as read out by the bar code reader 6 into the RAM 32. More particularly, at the time of an automatic performance, tone duration data read out from the RAM 32 is latched in a latch 47 while at the same time the content of a counter 48 which is reset by the reset signal from the control section 27, and the content of the latch 47, are compared in a coincidence circuit 46, and the tone termination signal is obtained when a coincidence is detected.

When the auto play switch 19 on the operating section 4 is operated, a signal AUTO is provided from the operating section 4 to an auto play control section 34. When the signal AUTO is supplied to it, the auto play control section 34 provides a one-shot pulse signal A which is supplied to the control section 27, causing the section 27 to provide the read/write control signal R/W for specifying the reading operation of the RAM 32. The reading operation of the RAM 32 is released when an end code stored in a predetermined area of the RAM 32 is supplied to the control section 27 via a bus line R1. When the repeat switch 20 on the operating section 4 is operated a predetermined number of times, data representing the number of times of operation is supplied from the operating section 4 through the bus line M to the control section 27, while at the same time the auto play control section 34 is set from the control section 27 through the bus line P. The data of the number of times of operation as set in the auto play control section 34 is incremented by "−1" every time the end code is supplied via the bus line R1, and the one-shot signal A is provided every time the end code is supplied until the content of the data representing the number of times of operation becomes "0".

The signal 1 key provided from the AND gate 28 is supplied to a tone length or duration counter 35. The tone duration counter 35 counts a predetermined frequency signal (not shown), and it is reset to start a counting operation afresh every time the output signal of the AND gate 28 is inverted from "1" to "0", i.e., every time the one key play key 8 is operated. The count data of the tone duration counter 35 is temporarily stored as tone duration data in an area **36*a* of a buffer 36. Of the pitch data stored in the individual areas of the RAM 32, one which is read out from a specified address area is supplid through the bus line R1 to an area 36*b* of the buffer 36 and temporarily stored therein. The content in the area 36*a* of the buffer 36 is read out and written in the specified address area of the RAM 32 when a read instruction signal RD is supplied from the control section 27 every time the one key play key 8** is operated.

When the address of the RAM 32 is progressively advanced according to the content of the address counter 33, the RAM 32 supplies step data representing the number of steps to a latch 38 through a bus line R2. When the musical instrument of this embodiment is set to the NAVI mode, pitch data stored in the specified address area of the RAM 32 is output through the bus line R2.

The step data provided from the latch 38 is supplied as display data through a driver 39 to the display section 21. The display section 21 is driven to digitally display the step data when a timing signal DT is supplied from the control section 27 through a decoder 40. The pitch data provided from the latch 38 is supplied as display data through a driver 41 to a LED matrix circuit 42. The LED matrix circuit 42 is driven by the timing signal DT supplied from the control section 27 through a decoder 43, whereby predetermined display members 7 are turned on according to the pitch data.

When a display member 7 is turned on, it indicates that the corresponding key on the keyboard 2 is to be operated next. In case the indicated key is not operated but a different key is operated by mistake, the control section 27 will not provide the "+1" signal.

A logic signal provided from the bar code reader 6 is supplied to the control section 27. The logic signal provided from the control section 27 is supplied through the bus line B to the RAM 32 to be successively written in respective area of specified addresses.

Figures 5, 6:
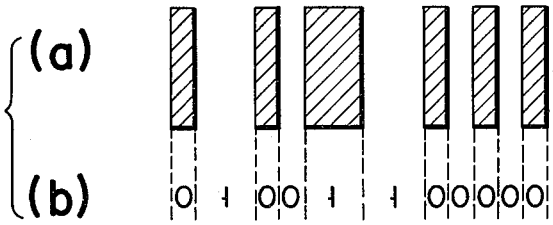

When bar codes, for instance as shown in (a) in FIG. 5, are scanned by the bar code reader 6, signals of "1" and "0" corresponding to respective widths of the bar codes are provided irrespective of whether the bar codes are black or white as shown in (b) in FIG. 5.

Figure 14:
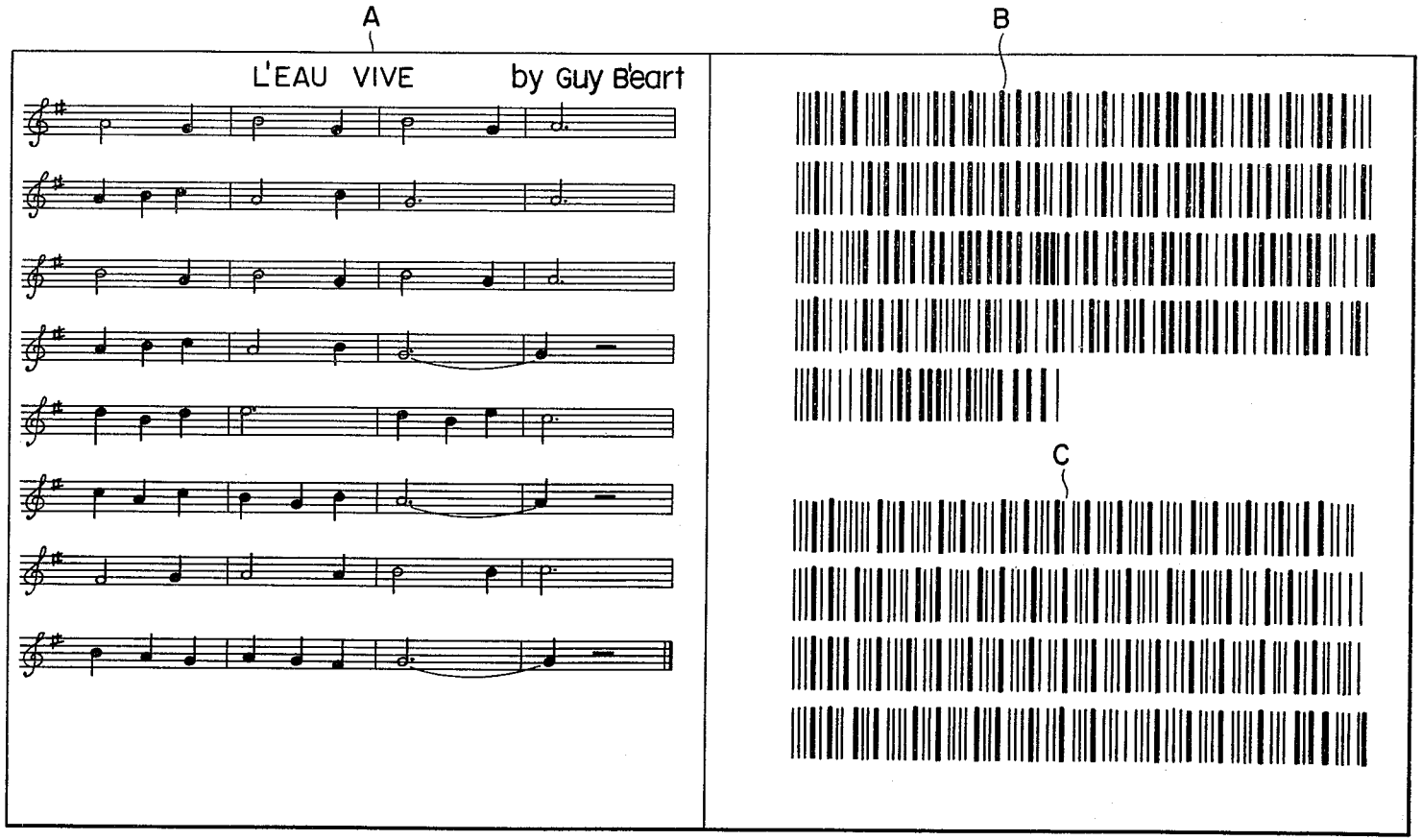
FIG. 14 is a view showing a score of the same piece of music and bar codes representing pitches and durations of tones corresponding to FIGS. 12 and 13.

FIG. 12 shows binary codes of tone data for successive notes on a score as shown in FIG. 14. In FIG. 12, the first and second lines form a first bar code line, the third and fourth lines form a second bar code line, the fifth and sixth lines form a third bar code line, the seventh and eighth lines form a fourth bar code line, and the nineth line forms a fifth bar code line. A dummy (as shown in FIG. 6) is set in the leading areas (1), (21), (41), (60) and (80) in the individual bar code lines. The dummy is provided for determining the speed with which the bar code reader 6 is scanning and setting a reference "0" level.

The areas (2), (22), (42), (61) and (81) are start marks (see FIG. 6) of the individual bar code lines. The areas (3), (23), (43) (62) and (83) are provided for specifying tone data (see FIG. 6). The area (4) is a pitch start mark (see FIG. 6). In the areas (5) to (17), (24) to (37), (44) to (56), (63) to (76) and (83) to (87), tone data corresponding to respective notes on the score are successively set. The individual pitches are represented by respective 4-bit codes as shown in FIG. 7, and the individual octaves are represented by 4-bit codes as shown in FIG. 8. A rest is represented by an 8-bit code as shown in FIG. 9. Thus, a note F4, for instance, is represented by an 8-bit code as shown in FIG. 10. With this code system, the tones in the areas (5) to (17) in the first bar code line are respectively B4, G4, B4, G4, B4, G4, A4, A4, B4, C3, A4, B4 and G4.

In the areas (18), (38), (57), (77) and (88) end marks (see FIG. 6) representing the end of each bar code line are set. In each of the subsequent areas (19), (39), (58) and (78), a continuation (see FIG. 6), indicating that the relevant bar code line continues to the next line, is set. In the area (89), a termination (see FIG. 6) indicating that the relevant bar code line is the last line, is set.

In the areas (20), (40), (59), (79) and (90), check sums are set, that is, these areas are provided for checking if varous data are accurately read and inputted. The bits in the check sum areas are set to be complementary of 16. In the error checking process, the 8-bit data in the areas (4) to (17) is handled as a two-unit data each of which is made of 4 bits. Thus, whether the total of the bits of the areas (3), (4) to (17) and (20) is a multiple of 16 is checked in the first line in FIG. 12. In the second line, the bits in the areas (23) to (37) are added with the summed value of the first line to check whether the resultant sum is a multiple of 16. Similar checking processes are done as to the following lines.

FIG. 13 shows binary codes representing tone duration data for the successive notes on the score in FIG. 14. In this case, like the case of FIG. 12, four bar code lines are provided. Like the case of FIG. 12, the leading areas (101), (122), (143) and (164) of the individual lines in FIG. 13 are each a dummy, and the subsequent areas (102), (123), (144) and (165) represent start marks in the individual lines. The areas (103), (124), (145) and (166) are tone duration data designation areas (see FIG. 6), and the subsequent areas (104), (125), (146) and (167) represent tone duration data start marks (see FIG. 6). In the areas (105) to (118), (125) to (139), (146) to (160) and (167) to (181), tone duration data for the successive notes on the score are set. The individual tone durations are represented by 8-bit codes as shown in FIG. 11.

With this code system, the tone durations of the areas (105) to (118) in the first bar code line, for instance, are respectively half note, quarter note, half note, quarter note, half note, quarter note, dotted half note, quarter note, quarter note, quarter note, half note, quarter note, dotted half note and dotted half note.

The areas (119), (140), (161) and (182) each represent an end mark, the areas (120), (141) and (162) each represent continuation, the area (183) represents termination, and the areas (121), (142), (163) and (184) are check sum setting areas, like the case of FIG. 12.

The binary codes as mentioned above are coded in the manner as shown in FIG. 5 into bar codes as shown in FIG. 14 adjacent to the right side of the score A. In the right column in FIG. 14, the upper portion B contains the bar codes for pitches, and the lower portion C contains the bar codes for durations. The individual lines in the upper portion B in the right column of FIG. 14 coincide with the corresponding lines in FIG. 12, and the individual lines in the lower portion C in the right column of FIG. 14 coincide with the corresponding line in FIG. 13. The score on the left column in FIG. 14 corresponds to the bar code sets on the right column.

The operation of the embodiment having the above construction will now bedescribed. First, the operation will be described in connection with the case of writing a series of tone data constituting a desired piece of music in the RAM 32 by keying operation. In this case, the mode selection switch 12 is set to the position REC for the recording mode. At this time, with the output signal provided from the mode selection switch 12 to the control section 27, the control section 27 provides the reset signal R to reset the address counter 33, i.e., make the content thereof "0", while it also executes control operation with respect to the recording mode to provide the read/write control signal R/W as a write instruction to the RAM 32. As a result, the RAM 32 is made ready for writing, and also its address "0" is specified. In this case, a step number "1" is first digitally displayed on the display section 21 in accordance with the address specification for the RAM 32.

Then, keys on the keyboard 2 are operated while reading out pitches of the successive tones constituting the piece of music from the score from the first tone. In the case of writing the individual tones on the score of FIG. 14, since the first tone is of the pitch B4, the key for the pitch B4 is first operated, whereby pitch data representing the pitch B4 is provided from the control section 27 and written in the "0" address area of the RAM 32. At the same time, the sound of the pitch B4 is produced according to the pitch data for the pitch B4 provided from the control section 27. Further, with the operation of the above key the "+1" signal is provided from the control section 27 to renew the content of the address counter 33 to "1". As a result, the display content on the display section 21 is changed to "2". For the second tone, which is of the pitch G4, the key for G4 is operated, whereby data for the pitch G4 is written in the "1" address area of the RAM 32 and also the sound for the pitch G4 is produced. At the same time, the content of the address counter 33 is renewed to "2", to change the display content on the display section 21 to "3". In this way, as the keys for the successive pitches are operated, the tone data corresponding to these operated keys are successively written in the RAM 32. When a rest occurs on the score A, the rest switch 16 is operated, whereby rest data is written in the specified address of the RAM 32. Finally, the end switch 17 is operated to write an end mark representing the end of the score A in the RAM 32.

When the operation of writing pitch data in the above way is ended, the reset switch 18 is operated with the mode selection switch 12 held at the position REC. As a result, the address counter 33 is reset, i.e., its content is reduced to "0", while at the same time the "0" address of the RAM 32 is specified and also "1" is displayed on the display section 21. Then, the one key play key 8 is operated, whereby the signal "1" is provided from the AND gate 28 to the control section 27 and tone duration counter 35. Thus, when the output signal of the AND gate 28 is supplied, the tone duration counter 35 is reset and starts counting of a signal at a given frequency. The count data of the tone duration counter 33 is transferred to the area 36*a* of the buffer 36 and temporarily stored therein. At the same time, pitch data for the first tone having been written in the "0" address area of the RAM 32 is read out for producing sound of the relevant tone for the period of operation of the one key play key 8, while it is transferred to the area 36*b* of the buffer 36 and temporarily stored therein. When a predetermined period from the operation of the one key play key 8, i.e., a period corresponding to the tone duration of the first tone (which is the half note in the case of the score on FIG. 14) has elapsed, the one key play key 8 is operated once again. As a result, the control section 27 provides the read instruction signal RD, causing the pitch data and duration data written in the areas 36*a* and 36*b* of the buffer 36 to be read out and written in the "0" address area of the RAM 32, while at the same time the control section 27 provides the "+1" signal to renew the content of the address counter 33 to "1". Subsequently, the tone duration counter 35 is reset to start afresh the counting of a signal at a given frequency. Thus, the tone duration data written in the RAM 32 does not represent the period of operation of the one key play key 8, but rather the period until the one key play key 8 is operated after the previous operation thereof. In the above way, the tone duration data for the individual tones are successively written in the RAM 32 by operating the one key play key at intervals corresponding to the tone durations of the individual tones. When a rest occurs on the score, the one key play key 8 is operated for a period corresponding to the duration of the rest. Finally, the one key play key 8 is operated for a period corresponding to the duration of the final note or rest to write the appropriate duration data in the RAM 32.

Figure 15:
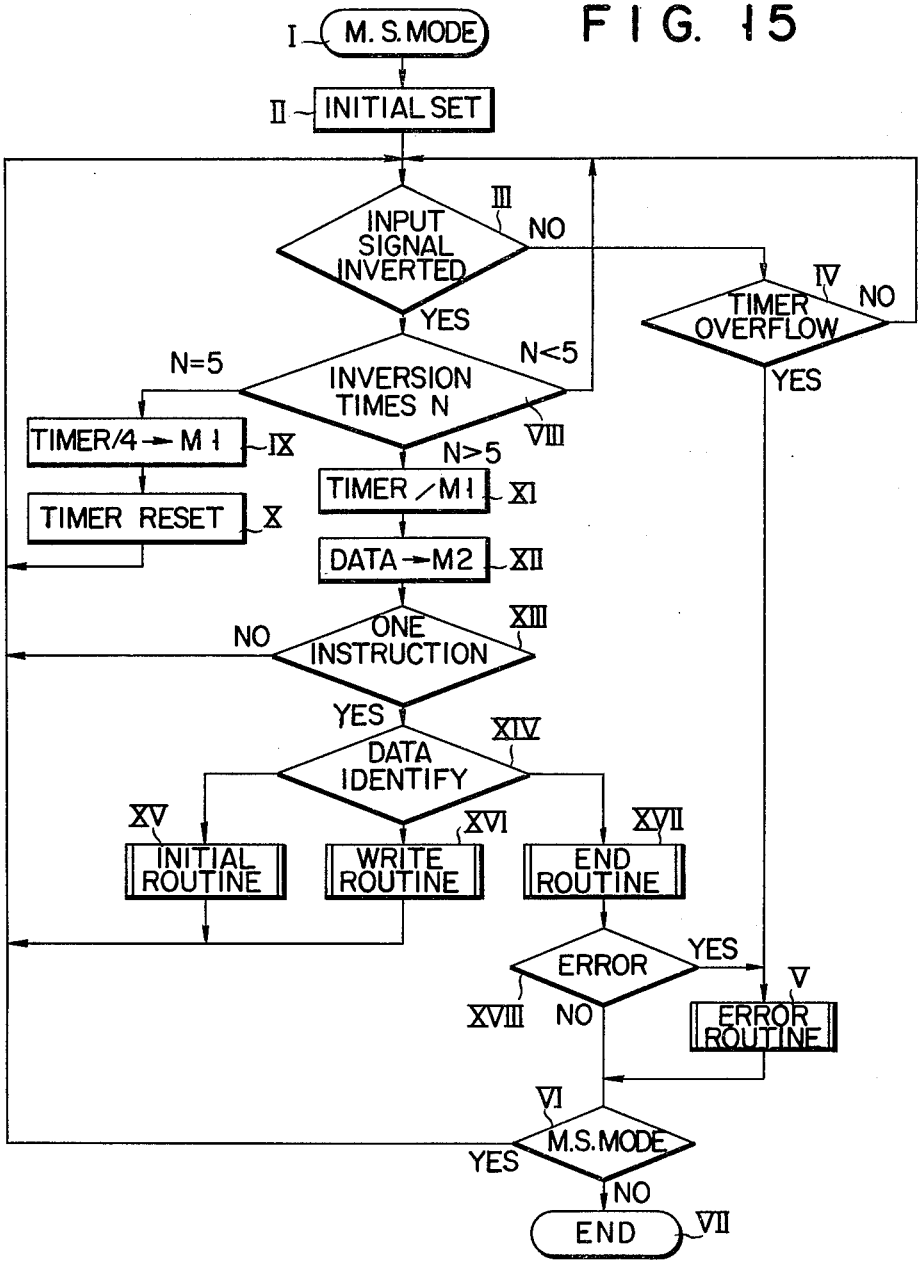
FIG. 15 is a flow chart showing the operation of writing bar code data as read out from a bar code reader, into a memory (music setter mode)

The operation of writing the pitch and duration data in the RAM 32 by using the bar code reader 6, will now be described with reference to FIG. 15. The case of writing the individual tones of the music shown by the score in FIG. 14 is taken. In a step I, the mode selection switch 12 is set to the position B.C.R., and the bar code reader 6 is set to the operative state of a music setter (M.S.) mode. At this time, the control section 27 executes a step II, in which initial setting for the M.S. mode is effected according to the output signal from the mode selection switch 12. More particularly, the control section 27 sets the RAM 32 to the write ready state while resetting the address counter 33 to "0". Thus, the "0" address of the RAM 32 is specified. In this state, the bar codes in the individual bar code lines printed on the right column in FIG. 14 are progressively scanned from the first line. In the first place, the bar codes representing the pitch data in the upper portion B of the right column in FIG. 14 are scanned. In a step III, whether there is an inversion of an input signal read out from the reader 6 scanning the bar codes B from "1" to "0" or from "0" to "1" is checked. If the bar codes B are not accurately scanned by the reader 6, no inversion of input signal occurs, and an overflow occurs in a timer. This is detected in a step IV, and the operation proceeds to a routine in a subsequent step VI. In the step VI, whether the M.S. mode prevails is checked. If it is detected that the M.S. mode prevails, the operation returns to the step III. Even if the input signal is not inverted, the operation returns to the step III unless no overflow occurs in the timer. If it is not detected in the step VI that the M.S. mode prevails, the operation goes to an END step VII.

If the bar codes B are correctly scanned by the reader 6 so that the input signal is inverted according to the bar code content, it is detected in the step III, and the number N of times of inversion is detected in a step VIII. When the bar codes B are successively correctly scanned from the code (1) in FIG. 12, for the code (1), which is a dummy code, the inversion times number is N=5. When N=5 is detected, the operation goes to a step IX. In the step IX, the count value of the timer when N=5 is detected is divided by 4 to obtain the scan period for one bit of the dummy code (1), and this scan period data is written in memory M1. Then the timer is reset in a step X, and the operation goes back to the step III.

When the inversion times number N exceeds 5 after the resetting of the timer in the step X, a step XI is executed. In the step XI, the period counted in the timer is compared with the content of the memory M1 for checking whether the fifth bit is "0" or "1". The code data obtained in this way is stored in memory M2 in a step XII. In a subsequent step XIII, whether the code data stored in the memory M2 constitutes one instruction is checked. In the pitch data of FIG. 12, the first dummy code (1), start mark code (2) and pitch data specification code (3) are all 4-bit data, and with either of these data a subsequent code identity judging step XIV is executed. Otherwise, the operation goes back to the step III.

When the input code is either code (1), (2) or (3), the operation goes to an initial routine execution step XV. When the initial routine is ended, the operation goes back to the step III.

When 8-bit data subsequent to the code (4) representing the pitch start mark data is coupled as the input code, a step XVI which is a write routine is executed after the step XIV. In the write routine, the pitch data is written in the RAM 32 (FIG. 4). When the data of the codes (5) to (17) are written in the RAM 32, the end mark code (18) is then read out. Then, a step XVII which is an END routine step is executed. After the END routine has been executed, the continuation code (19) is read out, and then the check sum code (20) is read out. An error check routine using the check sum code (20) is executed as a step XVIII. If there is no error, the operation returns from the step VI to the step III, followed by reading of data in the second bar code line of the pitch code data B. If an error is detected, an error routine is executed as a step V. In the error routine, the error is disposed with, and then repeated scanning by the reader 6 is executed. In the above way, the address of the RAM 32 is progressively renewed according to the bit number of the bar code data read out by the bar code reader 6, so that the bar code data are successively written in the same order as when they are read out in successive areas from the "0" address area of the RAM 32. Likewise, as the bar codes for the tone duration data in the lower portion C of the right column in FIG. 14 are progressively scanned, the bar code data are written in successive areas from the "0" address area of the RAM 32. In the individual areas of the ram 32, the bar code data for the tone pitch and those for the tone duration correspond to one another.

Figure 16:
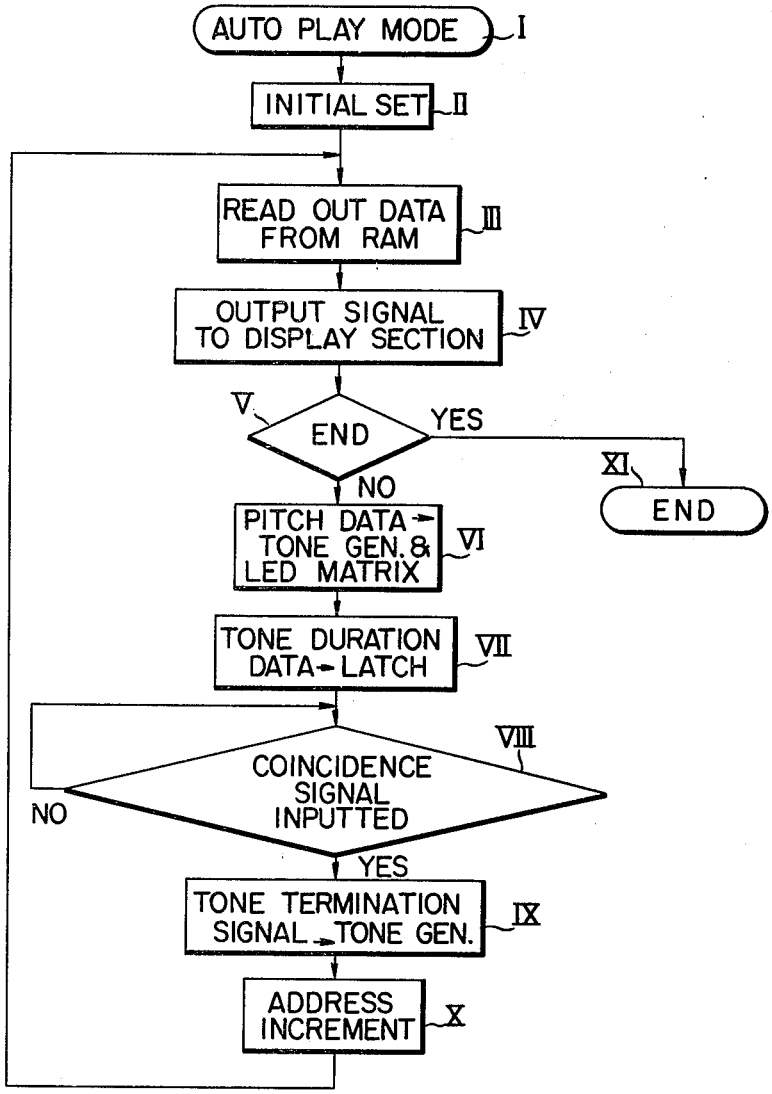
FIG. 16 is a flow chart showing the operation of automatically producing performance of melody with the reading of tone data stored in the memory.

The operation will now be described in connection with the case of causing auto play performance of music to be executed through reading of the pitch and duration data that have been written in the RAM 32 in the manner as described above, with reference to FIG. 16. In a step I, the mode selection switch 12 is set to the position NOR. Then, the auto play switch 19 is operated, whereupon the control section 27 provides the signal AUTO, and the one-shot signal A provided from the auto play control section 34 is supplied to the control section 27. Thus, in a step II the RAM 32 is set to the read ready state while the address counter 33 is reset to "0". Thus, in a step III the "0" address of the RAM 32 is specified, and the pitch data representing the pitch B4 and duration data representing the half note for the first tone stored in that area are read out. Then, in a step VI the sound of the first tone is produced. Also, in a step IV the step number of the RAM 32 (which is initially "1") is displayed on the display section 21. In the step VI the pitch data for the pitch B4 read out from the RAM 32 is supplied to the LED matrix circuit 42 to cause the display member 7 corresponding to the key for B4 to be turned on. In a step V preceding the step VI, whether the read-out data is an END data is checked. Simultaneously with the transfer of the pitch data to the tone generating section 45 and LED matrix circuit 42 in the step VI, in a step VII the tone duration data is latched in the latch 47, and in a step VIII whether a coincidence signal is coupled from the coincidence circuit 46 is checked. When a tone termination signal is supplied, at a step IX, to the tone generating section 45, the sound production for the first tone is ended to increment the content of the address counter 33 by "+1" to "1". The operation then returns to the step III. Thus, the pitch data for the pitch G4 and duration data for the quarter note for the second tone are read out from the RAM 32 to produce sound of that tone, and then the content of the address counter 33 is renewed to "2". The above sequence of operation is repeatedly executed to obtain automatic performance of music. When an end code is supplied from the RAM 32 to the control section 27, it is detected in the step V, and a step XI is executed to end the automatic performance of music.

When it is desired to repeatedly obtain automatic performance of music a plurality of times, the repeat switch 20 is operated the desired number of times, for instance four times. As a result, the repeat number data is provided from the control section 27 through the bus line P to the auto play control section 34 and set therein. The times number data set in the auto play control section 34 is decremented by "1" when an end code is supplied from the RAM 32 through the bus line R1 to the auto play control section 34 whenever the performance of the piece of music is ended. The auto play control section 34 produces one-shot pulse signals A until the repeat number data becomes "0", so that the automatic performance of music is repeatedly obtained a desired number of times, for instance four times.

Figure 17:
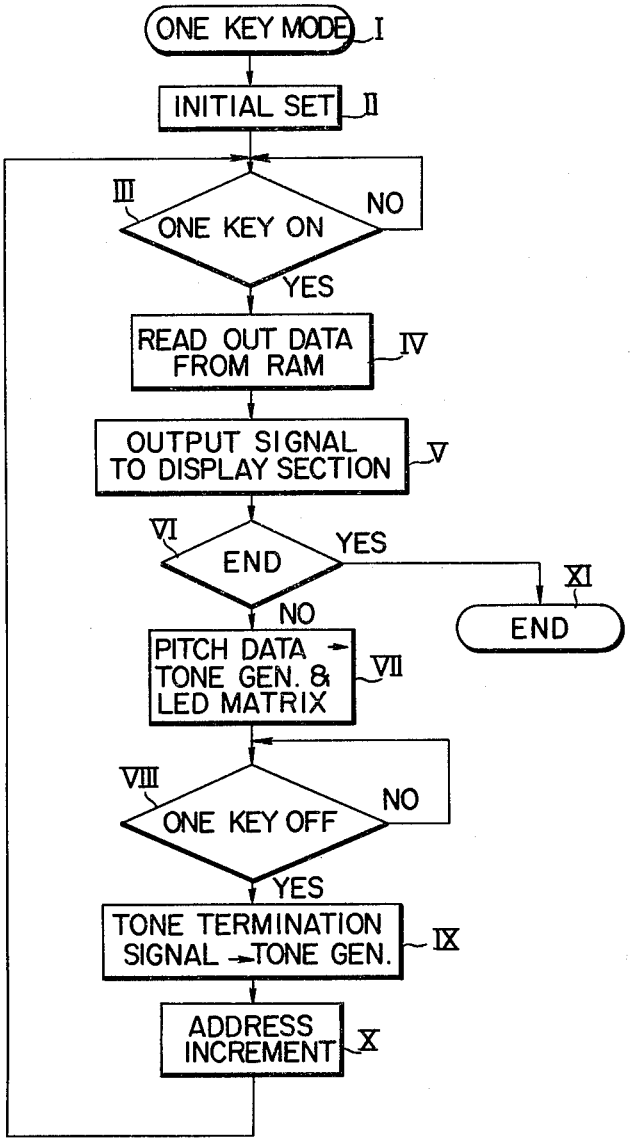
FIG. 17 is a flow chart showing the operation of one key play with the tone data stored in the memory read out by using a one key play key.

The operation will now be described in connection with the case of one key play performance with the pitch data successively read out from the RAM 32 by operating the one key play key 8, with reference to FIG. 17. In this case, the mode selection switch 12 is switched to the position NOR in a step I. As a result, in a step II the RAM 32 is set to the read ready state while the address counter 33 is reset to "0". Then, in a step III the one key play key 8 is operated. As a result, the signal "1 key" is produced from the operating section 4 and supplied to the control section 27. Thus, in a step IV the pitch data for B4 for the first tone stored in the "0" address area of the RAM 32 is read out. At the same time, in a step V a signal is suppled to the display section 21. At this time, whether the input data is an end code is checked in a step VI. If the data is not an end code, a step VII is executed, in which the pitch data is supplied to the tone generating section 45 and LED matrix circuit 42 for producing the sound for the first tone of B4. At this time "1" is displayed as the step number of the RAM 32 on the display section 21, and the data for the pitch B4 read out from the RAM 32 is supplied to the LED matrix circuit 42. As a result, the display member 7 corresponding to the key for the pitch B4 is turned on. Then, in a step VIII whether the key 8 is turned off is checked. If it is detected that the key is "off", a step IX is executed, in which a tone termination signal is supplied to the tone generating section 45 to end the production of sound. In this way, the sound for the first tone is produced with a tone duration corresponding to the period of operation of the one key play key 8. Then, in a step X the address is incremented. Subsequently, the one key play key 8 is operated again. As a result, the step III is executed again, and the data of the pitch G4 for the second tone is read out for producing the sound for the second tone of G4 while the display content of the display section 21 is changed to "2", causing the display member 7 corresponding to the key for the pitch G4 to be turned on.

In the manner as described above, the pitch data are read out from the RAM 32 one after another every time the one key play key 8 is operated, and the one key play performance of music, in which tones are each generated with a tone duration corresponding to the period of operation of the one key play key 8, is obtained. When the end code is read out, a step XI is executed, in which the performance is ended.

Figure 18:
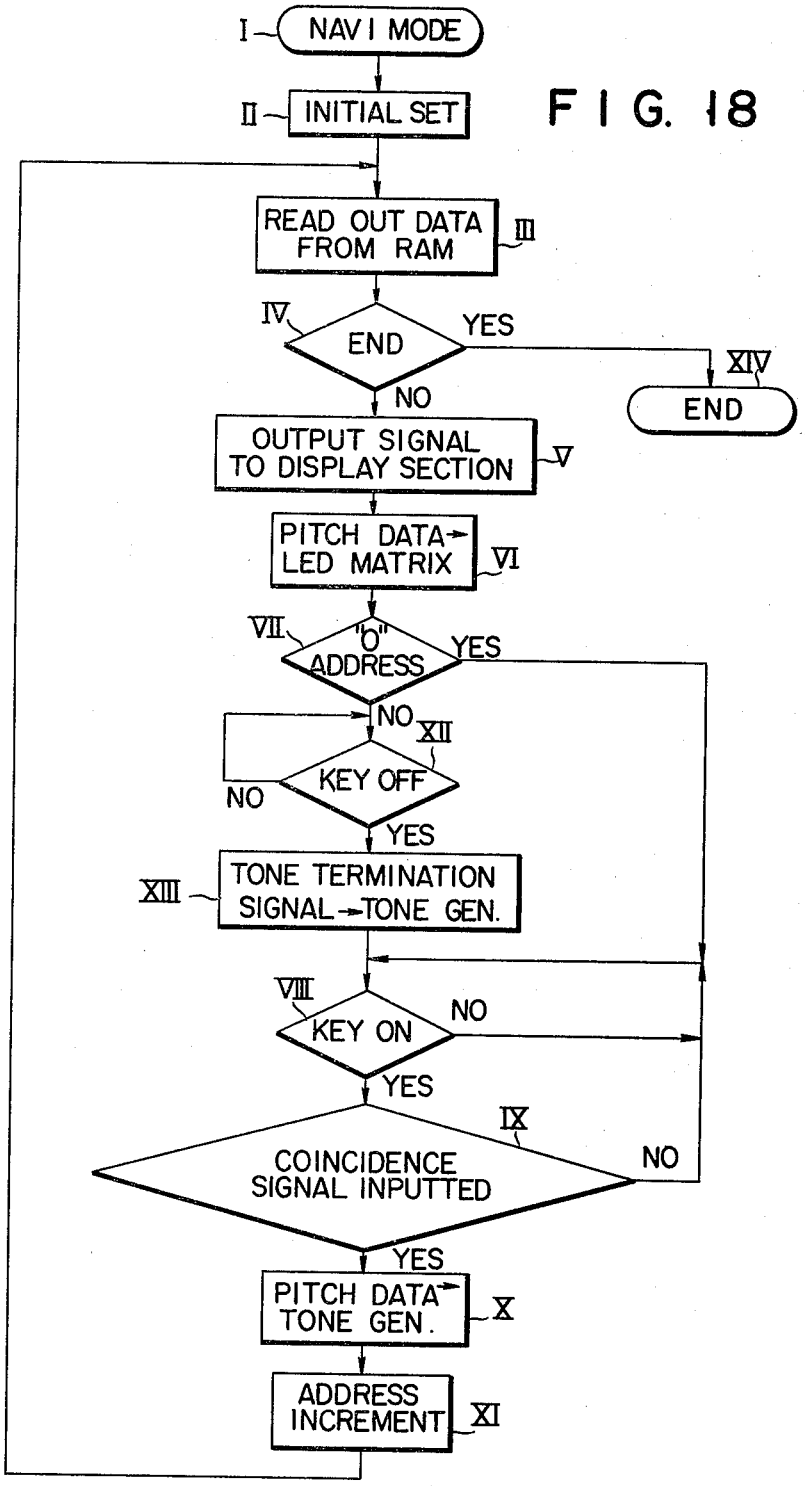
FIG. 18 is a flow chart showing the operation in a navigation mode in which performance keys are successively operated according to instructions by display members provided for the individual performance keys.

The operation will now be described in connection with the case of performance of music under the guide of key operation instructions by the display members 7 with reference to FIG. 18. In this case, the mode selection switch 12 is switched to the position NAVI to set the naviation mode. As a result, the initial setting is effected in a step II, setting the RAM 32 to the read ready state and resetting the address counter 33 to "0". Thus, in a step III tone data is read out from the RAM 32, and in a subsequent step IV whether the read-out data is an end data is checked. If it is not an end data, a step V is executed, in which the number "1" of the pitch data at the leading "0" address of the RAM 32 is displayed. After this display step is ended, a step VI is executed, in which the pitch data for the first tone (B4) is supplied to the LED matrix circuit 42 to turn on the LED 7 corresponding to the key for the pitch B4. In a subsequent step VII, whether the address of the RAM 32 is "0" is checked. If it is "0" a step VIII is executed, in which whether the key for B4 is operated is checked. If the key for B4 is not operated yet or a wrong key has been operated, the operation is stopped in the step VIII.

When the key for B4 is operated, a subsequent step IX is executed, in which whether the data for B4 read out from the RAM 32 and the keyed-in data coincide is checked in terms of the presence or absence of a coincidence signal. If a coincidence is detected, the data for B4 read-out in the step X is supplied to the tone generating section 45, and the tone signal for B4 is supplied to the loudspeaker 3. In a subsequent step XI, the address counter 33 is incremented, and the operation goes back to the step III. Thus, the pitch data for G4 in the "1" address is read out, causing the display member 7 corresponding to the key for the pitch G4 to be turned on, and indicating that the key for the pitch G4 is to be operated next.

When a key of G4 is depressed, the step VII goes to a step XII where the operation is circulated until the G4 key is released. While the G4 key is depressed the G4 sound is produced. When the G4 key is released the step XII shifts to a step XIII where a tone termination signal is sent forth to the tone generating section 45 thus terminating the G4 sound. Then the operation goes to the step VIII to await the next key depression.

If the key for the pitch G4 is not operated in conformity to the key operation instruction, the sound for the first tone is not produced. Also, the content of the address counter 33 is not renewed so that the display member 7 corresponding to the key for the pitch B4 remains "on". In other words, if the key operation in conformity to the key operation instruction is not effected, the player is informed of it in both the senses of seeing and hearing.

When the key is operated in conformity to the key operation instruction, the sound of the tone corresponding to the operated key is produced while at the same time the key which is to be operated next is displayed. Thus, even a beginner can produce correct performance of music by operating keys in conformity to the key operation instructions with only the rhythm born in mind.

As the performance of music progresses, successive step numbers of the RAM 32 are progressively displayed on the display section 21. When the END data is read out at the end of the performance, the step IV yields YES, so that the operation goes to a step XIV to end the performance of music in the naviation mode.

While in the above embodiment the bar codes have been based on an FM coding, it is also possible to adopt various other coding systems such as RZ, NRZ, NRZI, PE and MFM systems, and the form of bar codes is not limited to that in the above embodiment.

Further, while in the above embodiment the bar code reader has been constructed with a hand scanner, it is also possible to use a bar code reader, which can automatically read bar codes, and also the method of reading is not limited to that in the above embodiment.

Further, while in the above embodiment the bar code reader 6 has been securely connected to the musical instrument body 1 via the cord 5, it is also possible to removably connect the bar code reader to the body 1, for instance by a pin-and jack system. In this case, the bar code reader 6 can be connected to the body 1 only when it is used, which is very advantageous from the standpoints of performance and storage of the electronic keyboard musical instrument.

Further, while in the above embodiment only a single piece of music has been permitted to be stored in the RAM 32, it is of course possible to permit a plurality of pieces of music to be stored together. In this case, it is possible to permit a series of music pieces to be repeatedly performed in the repetitive performance mode, or permit only a specified music piece to be repeatedly performed.

Further, while in the above embodiment the key operation instruction has been provided by the "on" state of a display lamp, it is also possible to use any other display means such as blinking display to permit discrimination of a key to be operated next from the other keys.

Further, while in the above embodiment the failure of operation of a key in conformity to a key operation instruction has been signaled by stopping the sound production and also stopping the progress of the key operation instruction, such signalling means is by no means limitative. It is possible to cause the tone color, volume, etc. of the produced sound to be changed to signal a failure of a key operation in conformity to the instruction.

Further, while the above embodiment is concerned with an electronic keyboard musical instrument, the invention is also applicable to other apparatus such as a small size electronic calculator provided with a tone generating function.

As has been described in the foregoing, with the electronic musical instrument according to the invention, a bar code reader for reading bar code data from a medium on which a series of pitch data for a piece of music are recorded in the form of bar codes is provided, and the bar code data read out by the bar code reader are stored in a memory and are read out for specifying keys to be operated at the time of the performance of that piece of music. Thus, the series of pitch data constituting a piece of music can be stored in the memory very readily and in a short period of time, and the operability can be extremely improved. Further, unlike the case where pitch data are stored in a memory by operating keys, it is possible even for a person who cannot play the instrument or cannot read the score to store pitch data in the memory.

Further, since the bar codes may be printed on an ordinary paper sheet as a recording medium, great cost reduction is possible compared to the cases where magnetic cards, magnetic tapes or semiconductor memories are used for recording the tone data.

Further, correct performance can be obtained even by beginners so long as keys are operated in conformity to the key operation instructions, and it is possible to use tempo suited to the taste of the player for the performance of a piece of music under the guide of the key operation instructions. Thus, it is possible to obtain a great improvement in the result of training.

With another operation mode of the electronic musical instrument according to the invention, which is provided with a bar code reader for reading bar code data from a medium on which pitch data of a piece of music is recorded in the form of bar codes and in which bar code data read out by the bar code reader are stored in a memory and are read out therefrom one after another every time a one key play key is operated to obtain one key play performance, a series of tone data constituting the piece of music can be stored in the memory very readily and, in a short time of period, it is possible to improve greatly the operability. In addition, unlike the case where tone data are stored in a memory by operating keys, it is possible even for a person who cannot play a musical instrument or cannot read a score to store pitch data in the memory. Thus, performance of music can be obtained even by beginners without need of selecting keys in conformity to pitches but by merely complying with the rhythm pattern.

With still another operation mode of the electronic musical instrument according to the invention, which is provided with a bar code reader for reading bar code data from a medium on which tone data of a piece of music are recorded in the form of bar codes and in which bar code data read out by the bar code reader are stored in a memory and automatically read out therefrom for producing automatic performance of the music piece, a series of tone data constituting the music piece can be stored very readily and in a short period of time, and it is possible to improve greatly the operability. In addition, unlike the case where tone data are stored in a memory by operating keys, it is possible even for a person who cannot play a musical instrument or cannot read a score to store tone data in the memory. Thus, beginners can readily grasp the feel of even a piece of music performed for the very first time and enjoy the performance thereof by auto play.

What we claim is:

1. An electronic musical instrument comprising:

a plurality of performance keys, a bar code reader for reading bar code data from a recording medium on which predetermined tone data including at least pitch data and duration data are printed in the form of bar codes, memory means for digitally storing pitch data corresponding at least to the bar code data read out by said bar code reader, selection means for specifying first and second performance modes, first control means which operates when said first performance mode is specified by said selection means, said first control means comprising a plurality of display members each arranged to indicate a different one of the performance keys, first read out means responsive to operation of the performance key indicated by the associated display member, for reading out from said memory means pitch information corresponding to the next pitch to be played, display control means operative to discriminate from other display members, the display member of that performance key which corresponds to the pitch information read out by said first read out means and to activate said display member, second control means which operates when said second performance mode is specified by said selecting means, said second control means comprising second read out means which sequentially reads out the pitch data stored in said memory means in intervals following the duration data corresponding to the pitch data, and sound generating means which generates a sound in accordance with the pitch data and the duration data read out by said second read out means.

2. An electronic musical instrument comprising:

a plurality of performance keys, a bar code reader for reading bar code data from a recording medium on which predetermined tone data including at least pitch data and duration data are printed in the form of bar codes, memory means for digitally storing pitch data corresponding at least to the bar code data read out by said bar code reader, selection means for specifying first, second and third performance modes, first control means which operates when said first performance mode is specified by said selection means, said first control means comprising a read-out key which sequentially reads out, one at a time, pitch data stored in said memory means upon operation of said read-out key, and means for controlling the generation of sounds over time periods corresponding to the operation time of said read-out key, second control means which operates when said second performance mode is specified by said selection means, said second control means comprising a plurality of display members each arranged to indicate a different one of the performance keys, first read out means responsive to operation of the performance key indicated by the associated display member for reading out from said memory means the pitch data corresponding to the next pitch to be played, display control means operative to discriminate from other display members, the display member of that performance key which corresponds to the pitch data read out by said first read out means and to drive said display member, and third control means which operates when said third performance mode is specified by said selection means, said third control means comprising second read out means which sequentially reads out the pitch data stored in said memory means in intervals following the duration data corresponding to the pitch data, and sound generating means which generates a sound in accordance with the pitch data and the duration data read out by said second read out means.

3. The electronic musical instrument according to claim 1 or 2, wherein each of said plurality of display members is provided adjacent to the corresponding performance key.

4. The electronic musical instrument according to claims 1 or 2, wherein said bar code reader and said memory means are arranged to read and store tone data wherein the bar code of said pitch data is arranged in a sequential series and printed onto the recording medium in accordance with a musical progression, and the bar code of the duration data is arranged in a sequential series separate from the series of said pitch data and is also printed on said recording medium.

5. The electronic musical instrument according to claim 1 or 2, which further comprises a plurality of display members each provided in correspondence to each of the performance keys, and display control means for distinguishing a display member corresponding to a tone being generated from the other display members.

* * * * *